US005178216A

United States Patent [19]

Giroux et al.

[11] Patent Number: 5,178,216

[45] Date of Patent: Jan. 12, 1993

[54] WEDGE LOCK RING

[75] Inventors: Richard L. Giroux; John T. Brandell, both of Duncan, Okla.

[73] Assignee: Halliburton Company, Duncan, Okla.

[21] Appl. No.: 696,815

[22] Filed: May 7, 1991

Related U.S. Application Data

[63] Continuation-in-part of Ser. No. 515,883, Apr. 25, 1990, Pat. No. 5,038,862.

[51] Int. Cl.[5] ..... E21B 23/00; F16L 55/00

[52] U.S. Cl. ..... 166/242; 166/216; 285/321

[58] Field of Search ..... 175/320, 423; 166/85, 166/206, 216, 217, 242, 243, 289; 285/321

[56] References Cited

U.S. PATENT DOCUMENTS

| | | | |
|---|---|---|---|
| 3,427,048 | 2/1969 | Brown | 285/321 X |
| 4,550,936 | 11/1985 | Haeber et al. | 285/321 X |
| 4,603,886 | 8/1986 | Pallini, Jr. et al. | 285/321 X |
| 4,858,687 | 8/1989 | Watson et al. | 166/153 |
| 4,886,113 | 12/1989 | Ross et al. | 285/321 X |

OTHER PUBLICATIONS

Exhibit A-photocopy of pp. 1678-1685 of a text describing "Standard Tapers".

*Primary Examiner*—Terry Lee Melius

*Attorney, Agent, or Firm*—James R. Duzan; L. Wayne Beavers

[57] ABSTRACT

A wedge lock ring apparatus includes an outer housing having a housing bore with a housing groove defined therein. The housing groove has at least one and preferably has upper and lower housing groove tapered sides. An inner sleeve has a cylindrical outer surface with a sleeve groove defined therein, and the sleeve groove has at least one and preferably has upper and lower sleeve groove tapered sides. A wedge lock ring is received in the housing groove and the sleeve groove and has ring tapered edges complementary to the housing groove tapered sides and sleeve groove tapered sides, such that the sleeve and housing are locked against relative rotation by wedged engagement with the lock ring.

12 Claims, 7 Drawing Sheets

WEDGE LOCK RING

Related Applications

This application is a continuation-in-part of U.S. patent application Ser. No. 07/515,883 filed Apr. 25, 1990, U.S. Pat. No. 5,038,862.

BACKGROUND OF THE INVENTION

1. Field Of The Invention

The present invention relates generally to apparatus for connecting two concentric cylindrical members, and more particularly, but not by way of limitation, to apparatus wherein a well tool includes an inner cylindrical member which is to be drilled out of the tool.

2. Description Of The Prior Art

In the drilling of oil wells, certain tools are utilized which are subsequently drilled out of the well to remove them. For example, cementing tools which include internal sliding sleeves which open and close valve ports in an outer housing often are drilled out after the cementing job is completed. During the drilling out, the internal sleeves are drilled out of the outer housing thus providing a more open passageway down through the well.

Typically, the inner components of the cementing tool have been connected to the outer housing by threads, welding or the like.

SUMMARY OF THE INVENTION

The present invention provides an improved means for connecting inner and outer cylindrical members, and particularly for connecting inner members of a cementing tool, such as an anchor ring, to an outer housing so that they are subsequently held against rotation and can be drilled out of the housing.

The housing has a housing bore with a housing inner radius, and a housing groove defined in the housing bore with the housing groove having at least one housing groove tapered side. An inner sleeve, such as an anchor ring, has a cylindrical outer surface with a sleeve groove defined therein, said sleeve groove having at least one sleeve groove tapered side. A wedge lock ring is received in the housing groove and the sleeve groove, and has an inner tapered edge complementary to and engaging the sleeve groove tapered side and an outer tapered edge complementary to and engaging the housing groove tapered side, such that the sleeve and housing are locked against relative rotation by wedged engagement with the lock ring.

When it is subsequently desired to drill the inner sleeve out of the housing, the wedge lock ring holds the inner sleeve against rotation relative to the housing so that the inner sleeve can be easily drilled out of the housing.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
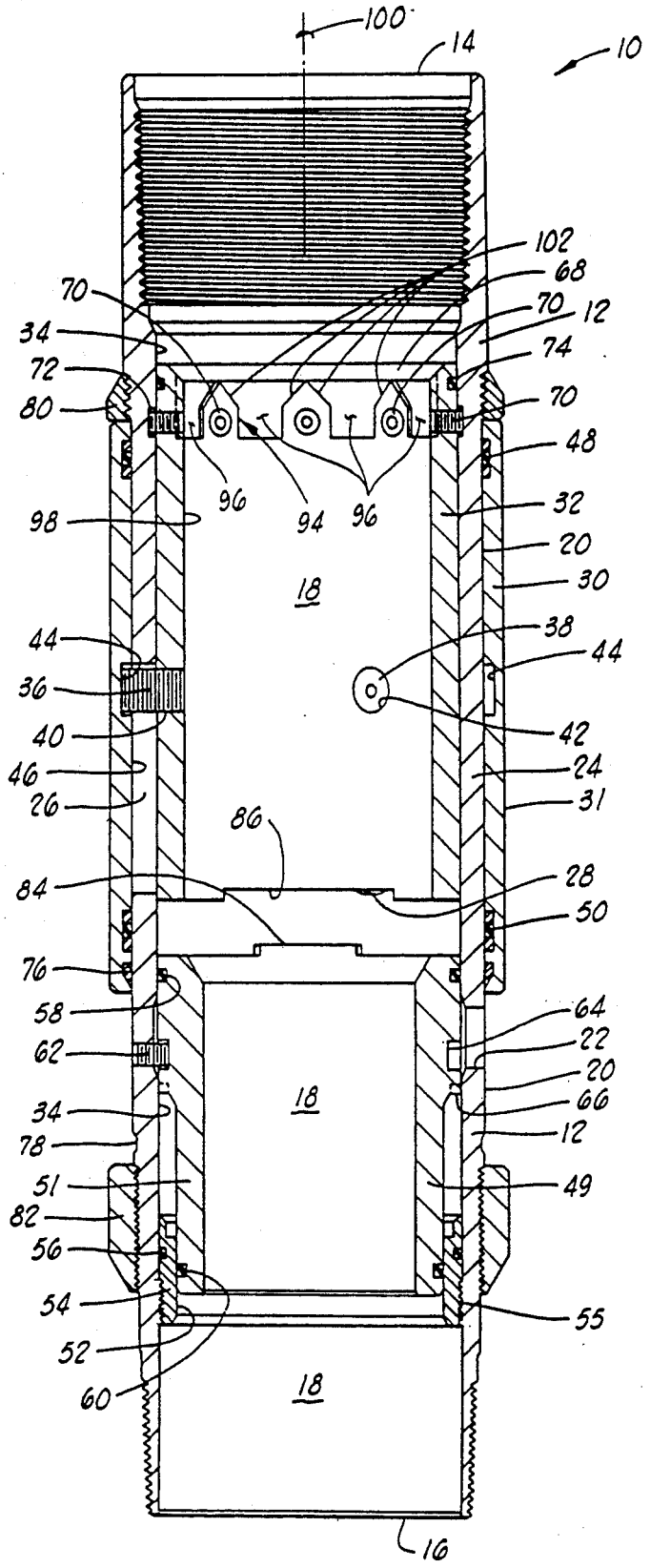
FIG. 1 is an elevation sectioned view of a cementing tool utilizing a hydraulically operated lower internal opening sleeve.

In FIG. 1, a cementing tool apparatus is shown and generally designated by the numeral 10. The cementing tool 10 includes a tubular housing 12 having an upper end 14 and a lower end 16 with an inner passage 18 defined longitudinally therethrough from the upper end 14 to the lower end 16.

The tubular housing 12 has a radially outer surface 20. The housing 12 also includes a wall 24 having one or more cementing ports 22 disposed therethrough. The wall 24 also has three longitudinal slots disposed therethrough, two of which slots are shown in FIG. 1 and designated as 26 and 28.

The cementing tool includes an outer, external closure sleeve 30 which is concentrically, closely slidably received about the outer surface 20 of housing 12. The closure sleeve 30 is movable relative to the housing 12 between an open position as seen in FIG. 1, and a closed position wherein the cementing port 22 is closed by closure sleeve 30.

The closure sleeve 30 can be described as an external sleeve and has a generally cylindrical radially outer surface 31 which is exposed to the well annulus 124.

Figure 7:
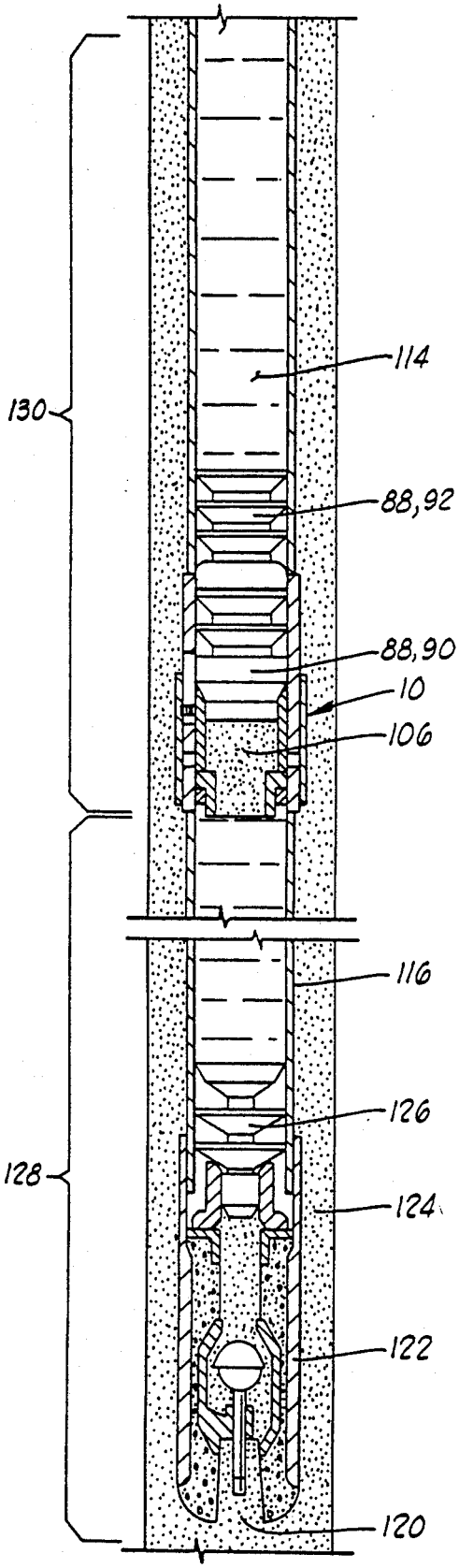

Cementing tool 10 includes an inner operating sleeve 32 which is slidably received in an inner bore 34 of housing 12. The operating sleeve 32 is slidable between a first position relative to housing 12 as seen in FIG. 1, and a second position corresponding to the closed position of closure sleeve 30 as schematically illustrated in FIG. 7.

Three pins, two of which are seen in FIG. and designated as 36 and 38, extend through the slots 26 and 28, respectively, and are fixably connected to the operating sleeve 32 and closure sleeve 30 to interlock the operating sleeve 32 and closure sleeve 30 for common longitudinal movement relative to the housing 12 throughout the entire movement of the operating sleeve 32 from its first position to its second position. Since the pins 36 and 38 fixedly connect operating sleeve 32 to closure sleeve 30, there is no lost longitudinal motion of the operating sleeve 32 relative to the closure sleeve 30 as the operating sleeve 32 moves downward to close the cementing port 22 with the closure sleeve 30.

The pins 36 and 38 are threadedly engaged with threaded radial bores such as 40 and 42 extending through the operating sleeve 32 and tightly engage an internal annular groove 44 cut in the inner bore 46 of closure sleeve 30.

The pins such as 36 and 38 and their engagement with the operating sleeve 32 and 30 can all be referred to as a mechanical interlocking means extending through the slots such as 26 and 28 and operably associated with both the operating sleeve 32 and the closure sleeve 30 for transferring a closing force from the operating sleeve 32 to the closure sleeve 30 and thereby moving the closure sleeve 30 to its closed position as the operating sleeve 32 moves from its first position to its second position.

Pins 36 and 38 also serve to hold sleeve 32 so that it will not rotate as sleeve 32 is later drilled out of housing 12 after the cementing job is completed.

The cementing tool 10 includes an upper sliding seal 48 and a lower sliding seal 50 disposed in annular grooves cut in the bore 46 of closure sleeve 30 near its upper and lower ends. Each of the upper and lower sliding seals 48 and 50 include an 0-ring held between two annular backup rings. When the closure sleeve 30 is in its open position as seen in FIG. i, both the seals 48 and 50 are located above the cementing port 22. When the closure sleeve 30 is moved downward to its closed position, the lower seal 50 is located below cementing port 22 and the upper seal 48 is located above the cementing port 22 to effectively close the cementing port 22. Thus, the apparatus 10 can be said to have two and only two sliding seals between the closure sleeve 30 and the outer surface 20 of housing 12, one of said seals 48 being located above the cementing port 22 and the other seal 50 being located below the cementing port 22 when the closure sleeve 30 is in its said closed position.

Since both the upper seal 48 and lower seal 50 engage identical outside diameters of the outer surface 20 of housing 12, there is no unbalanced hydraulic pressure acting on the closure sleeve 30. Thus, the closure sleeve 30 can be described as being longitudinally hydraulically balanced.

As is apparent in FIG. 1, the inner passageway 18 of housing 12 is always in fluid pressure communication with the bore 46 of closure sleeve 30 between its upper and lower seals 48 and 50. In the position illustrated in FIG. 1, there is no seal between the lower end of operating sleeve 32 and the slots such as 26 and 28, thus fluid pressure within the passage 18 will reach the bore 46 of closure sleeve 30 between the seals 48 and 50, but due to the fact that closure sleeve 30 is hydraulically balanced, this pressure will not exert any unbalanced longitudinal force on the closure sleeve 30.

Figure 4:
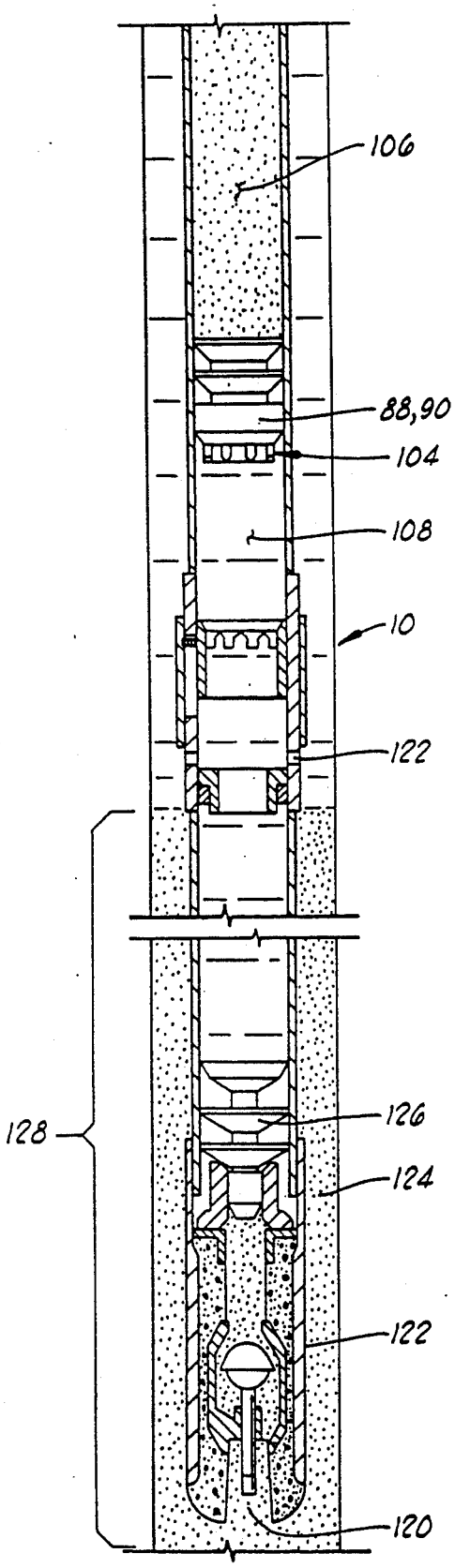

The cementing tool 10 further includes an internal lower opening sleeve 49 slidably received in the bore 34 of housing 12 below the operating sleeve 32. The opening sleeve 49 is slidable between a closed position as shown in FIG. wherein the cementing port 22 is closed by the opening sleeve 49 and an open position, such as is schematically illustrated in FIG. 4 wherein the cementing port 22 is uncovered by the opening sleeve 49 as the opening sleeve 49 moves downward relative to housing 12. It is noted that when the opening sleeve 49 is in its closed position as seen in FIG. 1 and the operating sleeve 32 is simultaneously in its first position as shown in FIG. 1, the inner passage 18 of housing 12 is in fluid pressure communication with the bore 46 of closure sleeve 30 between its sliding seals 48 and 50.

The opening sleeve 49 in the embodiment of FIG. 1 is a hydraulically operated sleeve. It includes a reduced diameter lower portion 51 which is slidably received within a bore 52 of an anchor ring 54 which is fixedly attached to the inner bore 34 of housing 12 such as by thread 55. An O-ring seal 56 seals between anchor ring 54 and housing 12.

Opening sleeve 49 carries an upper annular sliding seal 58 which engages the bore 34 of housing 12, and carries a lower annular sliding seal 60 which engages the reduced diameter bore 52 of anchor ring 54, so that a differential area is defined between 0-rings 58 and 60. Opening sleeve 49 is initially shear pinned in its closed position as shown in FIG. 1 by a plurality of shear pins 62 which are threaded through the wall of housing 12 and engage a groove 64 in opening sleeve 49.

As is further described below with regard to FIG. 4, the interior of the casing string in which the apparatus 10 is located can be closed off below the cementing tool 10 so that a high fluid pressure can be applied to the passage 18 through housing 12 which pressure will act downward on the differential area between 0-rings 58 and 60 until the force exceeds that which can be held by the shear pins 62. Then the shear pins 62 will shear and the downward acting differential pressure will move the opening sleeve 49 downward until a lower shoulder 66 thereof engages the anchor ring 54. At that point, the upper 0-ring 58 is located below cementing port 22 so that the cementing port 22 is open to the passage 18 through housing 12.

A non-rotating engagement is provided between the shoulder 66 of opening sleeve 49 and the upper end of anchor ring 54 by a lug and recess type interlocking structure (not shown) similar to lug 84 and recess 86 described below.

After the opening sleeve 49 has been moved down to its open position, cement can be pumped downward through the passage 18 and out the cementing port 22 in a manner further described below with reference to FIGS. 3-8.

After sufficient cement has been pumped out through cementing port 22, the closure sleeve 30 is closed by means of the operating sleeve 32. A closing force is applied to the operating sleeve 32 by a plug means which will seat on an annular seat 68 defined on the upper end of operating sleeve 32. The operating sleeve 32 is initially held in place relative to housing 12 by a plurality of shear pins 70 which are threaded through the operating sleeve 32 and received in a groove 72 in the bore 34 of housing 12. An upper sliding 0-ring 74 seals between the operating sleeve 32 and the housing 12.

When the shear pins 70 are sheared due to a downward force acting on the operating sleeve 32, the operating sleeve 32 moves downward carrying the closure sleeve 30 with it. The closure sleeve 30 carries an inwardly biased locking ring 76 in a groove contained near its lower end. The locking ring 76 will snap into an outer annular groove 78 defined in the housing 12 to mechanically lock the closure sleeve 30 in its closed position relative to housing 12.

Upper and lower external support rings 80 and 82 are fixedly attached to the housing 12 at or near the positions of the upper and lower ends of the closure sleeve 30 when the closure sleeve is in its open position and closed position, respectively. The support rings 80 and 82 have outside diameters equal to or greater than the outside diameter of closure sleeve 30 so that if the tool 10 is placed against the wall of a casing, the rings 80 and 82 will hold the tool such that the closure sleeve 30 can still slide downward relative to housing 12 without binding against the casing.

The opening sleeve 49 has an upward extending lug 84 which will be received within a downward facing recess 86 in the lower end of operating sleeve 32 when the operating sleeve 32 moves downward to a position corresponding to the closed position of closure sleeve 30. This prevents the operating sleeve 30 from rotating relative to the opening sleeve 49 and housing 12 at a later time when the internal components are drilled out of the housing 12.

The cementing tool 10 of FIG. is particularly designed for use with a cementing plug means 88 (see FIGS. 4–7) including a bottom plug 90 and a top plug 92. As is further described below, the cementing plug means 88 is used in connection with the second stage of cement which is pumped through the cementing port 22 of cementing tool 10.

The cementing tool 10 and its associated cementing plug means 88 are designed so that the cementing plug means 88 will not rotate relative to the housing 12 of cementing tool 10 when the cementing plug means 88 and other internal components of the cementing tool 10 are drilled out of the housing 12 after the cementing job is completed. This non-rotatable feature is provided in the following manner.

The operating sleeve 32 has a first non-rotatable engagement means generally designated by the numeral 94 defined thereon adjacent the annular seat 68 at the upper end thereof. This non-rotatable engagement means 94 includes eight recessed areas 96 defined in a radially inner surface 98 of operating sleeve 32. The eight recessed areas 96 are angularly spaced from each other about a longitudinal central axis 100 of the tool 10 and the operating sleeve 32.

The non-rotatable engagement means 94 also includes eight upward facing, hat-shaped camming surface means 102, each of which separates adjacent ones of the recessed areas 96.

Referring now to FIG. 4, the bottom plug 90 of cement plug means 88 has a similar, but inverted, second non-rotatable engagement means 104 defined on the lower end thereof. The second non-rotatable engagement means 94 also includes recessed areas and camming surfaces defined on an external surface thereof which are complementary to and designed such that the downward pointing hat-shaped camming surfaces of the second non-rotatable engagement means 104 of bottom plug 90 are received in the recesses 96 of operating sleeve 32 with the upward facing, hat-shaped camming surfaces 102 of operating sleeve 32 being received in recesses of the second non-rotatable engagement means 104, so that the bottom plug 90 interlocks with the operating sleeve 32 to prevent rotation therebetween.

As will be appreciated by those skilled in the art, the bottom plug 90 is utilized to separate the bottom of a column of cement 106 from well fluids 108 located therebelow to prevent contamination of the cement prior to the time it is pumped through the cementing port 22.

Figure 5:
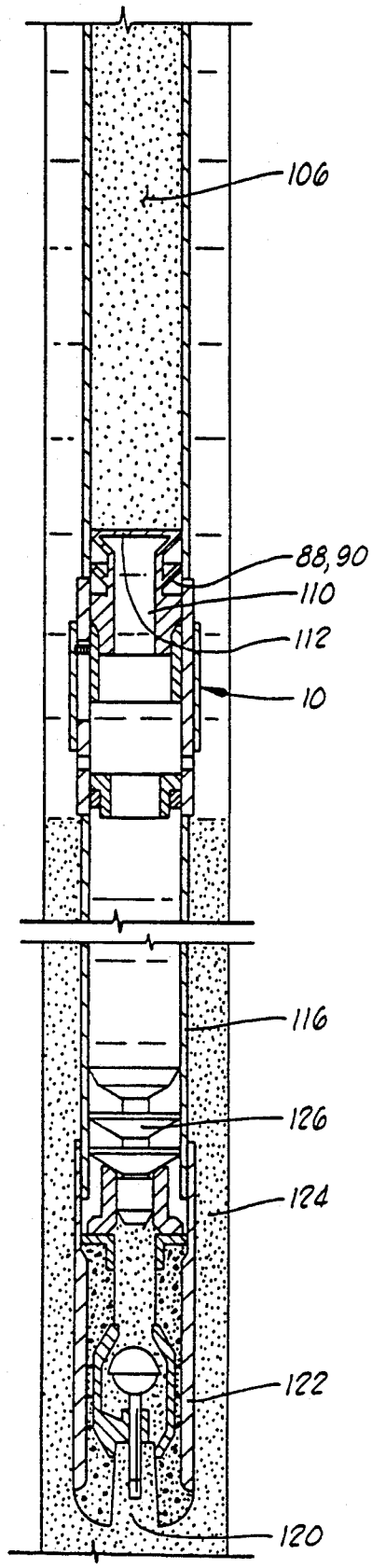

The bottom cementing plug 90, as best seen in the somewhat schematic sectioned view of FIG. 5 has a passage 110 therethrough which is initially closed by a rupture disc or diaphragm schematically illustrated as 112.

Figure 6:
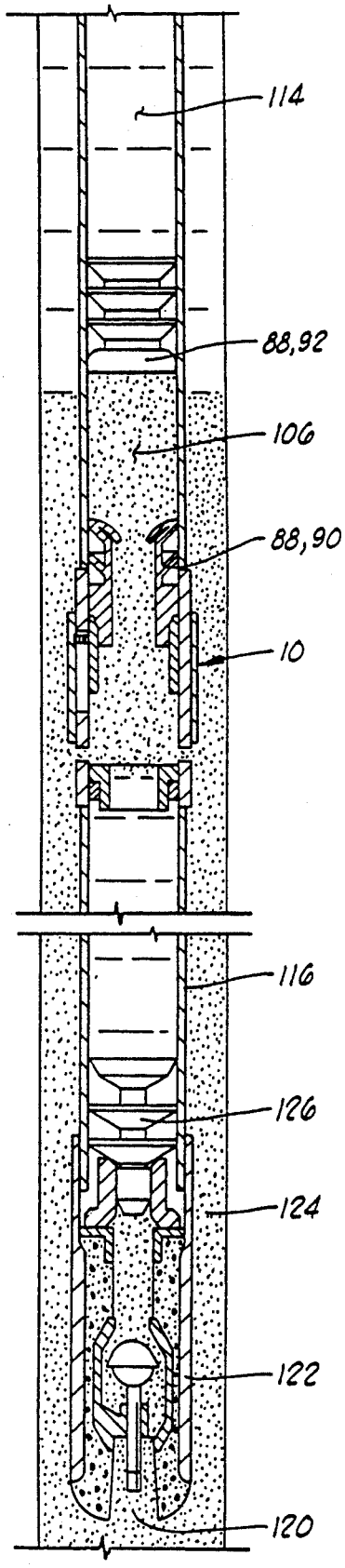

When the bottom plug 90 seats against seat 68 of operating sleeve 32 as schematically represented in FIG. 5, pressure on the cement column 106 is increased until the rupture disc 112 ruptures as represented in FIG. 6 thus permitting the cement to flow downward through the passage 110 of bottom plug 90 into the passage 18 of housing 12 of cementing tool 10 and out through cementing port 22.

As schematically illustrated in FIG. 6, the top plug 92 separates the upper extremity of the cement column 106 from a working fluid 114 thereabove. The top plug 92 is a closed plug having no passage therethrough, and when it engages bottom plug 90 as schematically illustrated in FIG. 7, the top plug 92 seals against bottom plug 90 closing the passage 110 therethrough. A non-rotatable engagement is provided between top plug 92 and bottom plug 90 to prevent top plug 92 from rotating relative to bottom plug 90 when the plugs are later drilled out. This non-rotatable engagement between the top and bottom plugs is like that shown in U.S. Pat. No. 4,858,687 to Watson et al. which is incorporated herein by reference.

After the top plug 92 has seated on the bottom plug 90 as schematically illustrated in FIG. 7, further fluid pressure can be applied to the working fluid 114 thereabove to shear the shear pin 70 holding the operating sleeve 32 in place relative to housing 12, thus allowing the operating sleeve 32 and closure sleeve 30 to move downward to the closed position of closure sleeve 30.

The shear pins 70 must be designed such that they can safely withstand the downward force applied thereto when pressure is applied to rupture the rupture disc 112 of bottom plug 90, and the shear pins 70 must also be designed so that they will shear and release the operating sleeve 32 at a predetermined pressure after the top plug 92 seats against bottom plug 90.

In the embodiment illustrated in FIG. 1, one of the shear pins 70 is located below each of the hat-shaped camming surfaces 102. The shear pins 70 may be collectively referred to as a releasable retaining means 70 for initially retaining the operating sleeve 32 in place relative to housing 12 with the cementing port 22 open as the rupture disc 112 of bottom cementing plug 90 is ruptured to open the passage 110 through the bottom cementing plug 90.

It is also noted that the apparatus 10 could be used with only a top cementing plug similar to plug 90 and having a non-rotatable engagement means similar to 104 defined thereon.

Methods Of Operation Utilizing The Apparatus Of FIG. 1

Turning now to FIGS. 3–8, the major steps of a multi-stage well cementing job utilizing the cementing tool 10 are schematically illustrated.

A well casing string 116 is located within a well bore 118.

The cementing tool 10 is placed in the casing string 116 before it is run into the well bore 118. It may be inserted between standard threaded connections of the casing at the desired locations of various cementing stages. A number of cementing stages are possible as long as each cementing tool 10 in the casing string 116 has a smaller inner diameter than the cementing tool immediately above it.

After the casing string 116 is in place within the well bore 118, the first or lowermost stage of cementing may be accomplished through a bottom opening 120 in a float shoe 122 arranged at the lower end of the casing string 116. The cement flows downward through casing 116 out the opening 120 and up into a well annulus 124 defined between the casing string 116 and well bore 118. A wiper plug 126 is inserted behind the first stage of cement slurry and displacing fluid of approximately the same specific gravity as the cement slurry is pumped behind the wiper plug 126 to displace the cement from the casing string 116.

As seen in FIG. 4, the wiper plug 126 will seat in the float shoe 122 thus stopping flow of the first stage of cement 128 up into the annulus 124. The first stage 128 of cement will extend to some point below the cementing port 122 of the cementing tool 10.

With the wiper plug 126 sealing the lower end of the casing string 116, pressure within the casing string 116 can be increased and will act against the differential area defined on opening sleeve 49 until the shear pins 62 are sheared and opening sleeve 49 of cementing tool 10 moves downward thus uncovering and opening the cementing port 22 as schematically illustrated in FIG. 4. Then, cement 106 for the second stage cementing can be pumped down the casing 116 with the displacing fluids located therebelow being circulated through the cementing port 122 and back up the annulus 124. As previously indicated, a bottom cementing plug 90 is run below the cement 106 and a top plug 92 is run at the upper extremity of the cement 106.

The bottom plug 90 will seat against operating sleeve 32 as illustrated in FIG. 5. Further pressure applied to the cement column 106 will rupture the rupture disc 112 of bottom cementing plug 90 as illustrated in FIG. 6, and the second stage cement then flows out of cementing port 122 and upward through the annulus 124.

When the top plug 92 seats against bottom plug 90 closing the same, as shown in FIG. 7, the second stage of cementing represented by annular cement column 130 is terminated.

Figure 8:
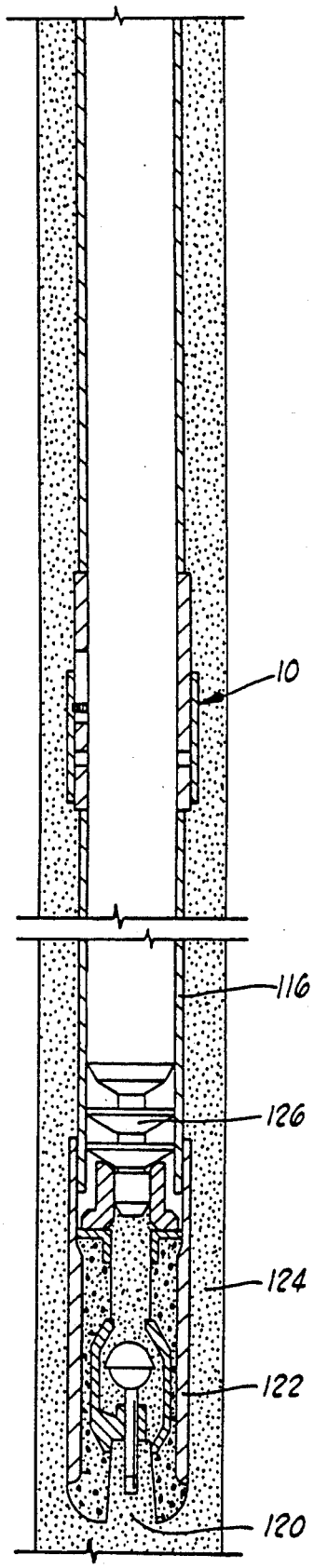

Subsequently, the cementing plugs 90 and 92, and the operating sleeve 32 and opening sleeve 49 and anchor ring 54 can all be drilled out of the casing 12 leaving a smooth bore through the cementing tool 10 as schematically illustrated in FIG. 8. The components to be drilled out of housing 12, including the operating sleeve 32, opening sleeve 49 and anchor ring 54 are all made from easily drillable materials such as aluminum. The cementing plugs 90 and 92 are also made of aluminum and rubber components which are easily drilled. Since all of these components are non-rotatably locked to each other and to the housing 12, the drilling of the same out of the housing 12 is further aided.

Figure 2:
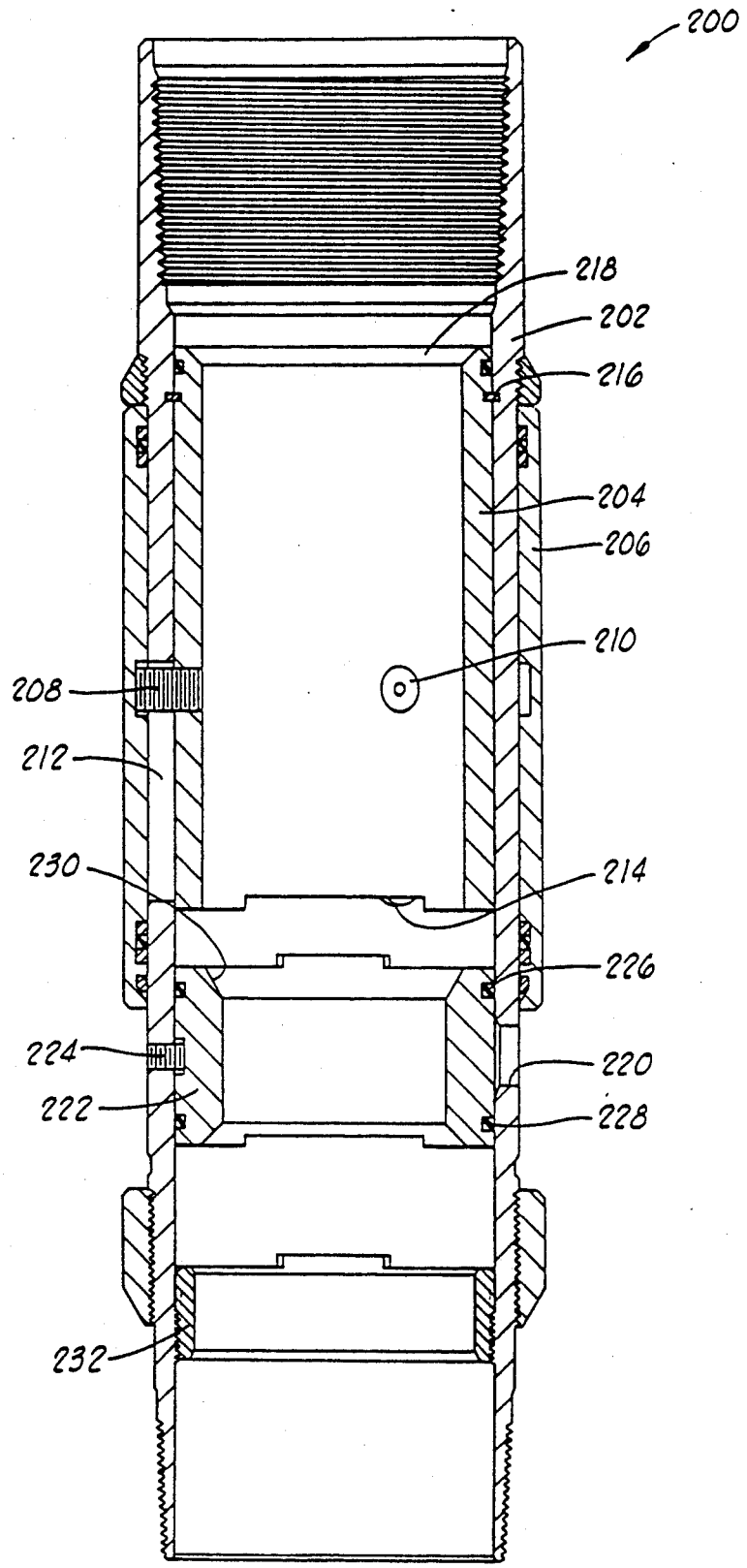
FIG. 2 is an elevation sectioned view of a cementing tool utilizing a plug actuated lower internal opening sleeve.
Figure 3:
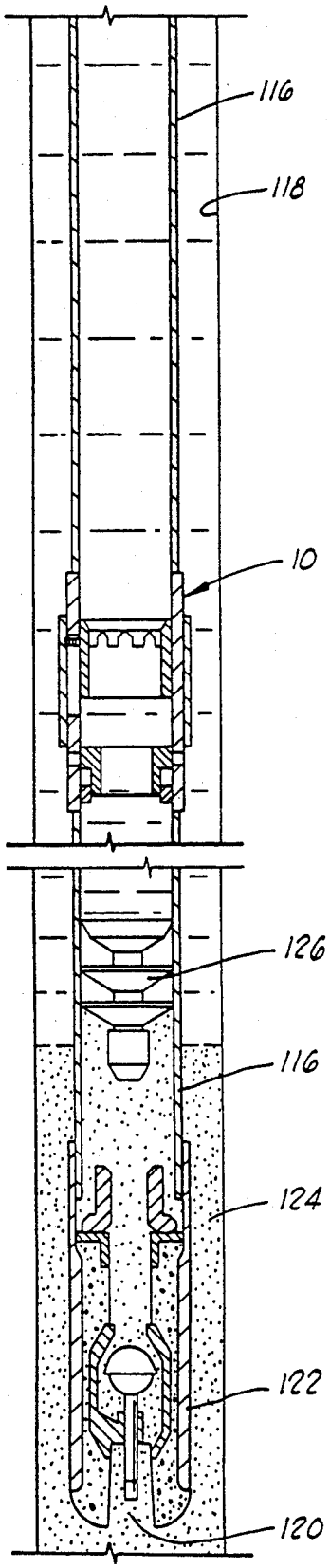
FIGS. 3–8 comprise a sequential series of views illustrating the use of the cementing tool of FIG. 1 to stage cement a wall.

Alternative Embodiment Of FIG. 2

FIG. 2 illustrates an alternative embodiment of a cementing tool which is shown and generally designated by the numeral 200. The cementing tool 200 differs primarily in that its opening sleeve is not hydraulically actuated but instead is designed to be actuated by engagement of a pump-down plug or free-fall plug which seals the opening through the opening sleeve.

The cementing tool 200 includes a housing 202. An operating sleeve 204 is received therein. A closure sleeve 206 is received about the housing 202. A series of pins such as 208 and 210 extend through slots 212 and 214 to fixedly connect the operating sleeve 204 and closure sleeve 206. A shear ring 216 initially holds the operating sleeve 204 in place relative to housing 202. An annular seat 218 is defined upon the upper end of operating sleeve 204 for engagement with a cementing plug.

A cementing port 220 is disposed through the housing 202. An opening sleeve 222 is located within the housing 202 and is initially held in place relative thereto by shear pins 224.

Upper and lower sliding 0-ring seals 226 and 228 are carried by opening sleeve 222. The seals 226 and 228 are above and below, respectively, the cementing port 220 when the opening sleeve 222 is in its initial closed position as shown in FIG. 2.

The opening sleeve 222 has a annular seat 230 defined on its upper end which is constructed for engagement with a pump-down plug (not shown). When the pump-down plug engages seat 230 fluid pressure applied thereto acts downward to shear the shear pins 224 so that the plug and opening sleeve 222 can move downward until the opening sleeve 222 abuts an anchor ring 232. The upper 0-ring seal 226 is then located below cementing port 220 so that a second stage of cement can be pumped out the cementing port 220 in a manner similar to that previously described with regard to the embodiment of FIG. 1.

The Wedge Lock Ring Of FIGS. 9–13

Figure 9:
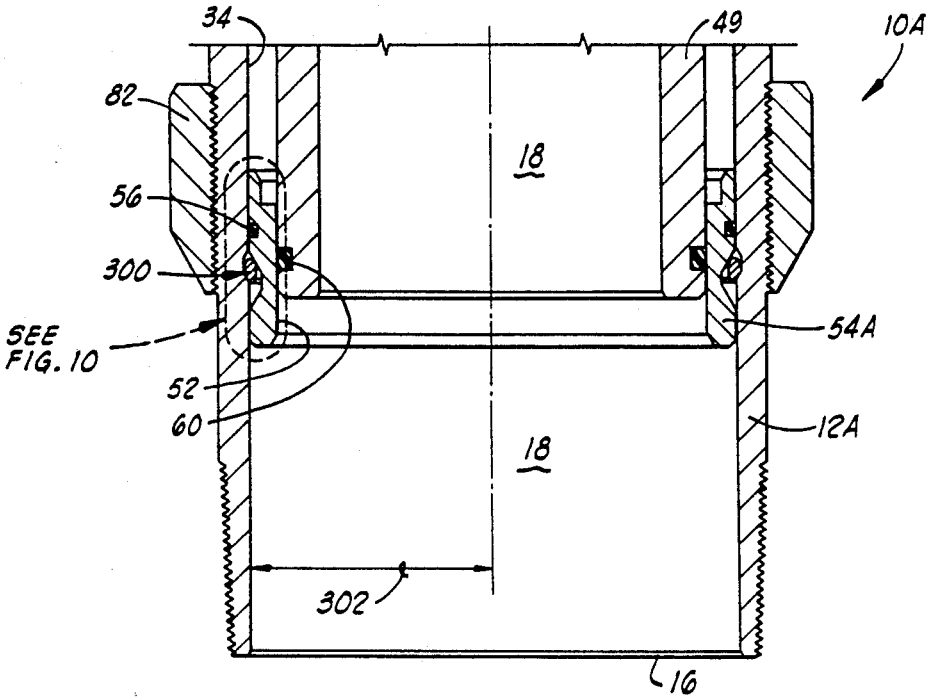
FIG. 9 is an elevation sectioned view of the lower portion of the apparatus of FIG. 1 illustrating the use of a wedge lock ring to connect the anchor ring to the housing.

FIGS. 9–13 show a view of the lower end of the cementing tool of FIG. 1 which has been modified in the manner in which the anchor ring 54 is connected to housing 12. The apparatus of FIG. 9 is identified by the numeral 10A. Components thereof identical to the apparatus 10 of FIG. 1 are identified by identical numerals. Modified components are identified with the suffix A.

Figure 10:
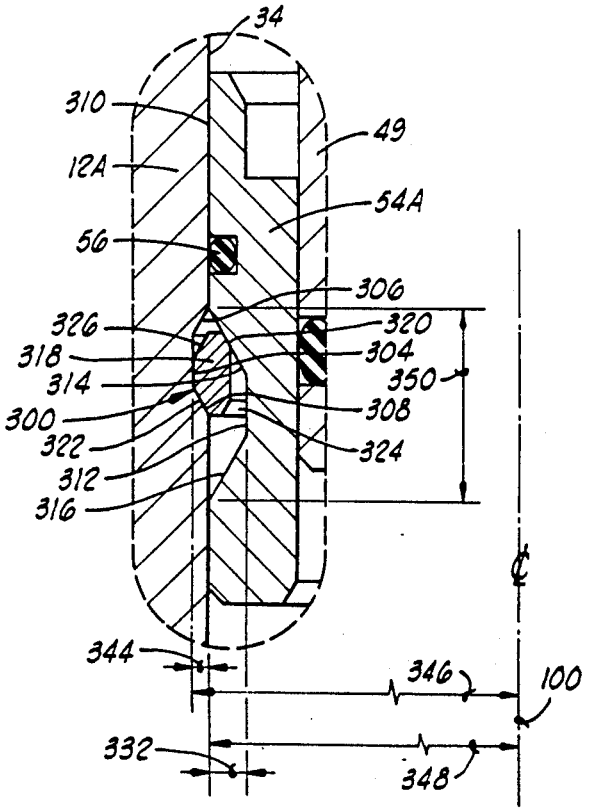
FIG. 10 is an enlarged view of the left-hand side of FIG. 9 in the area of the wedge lock ring as indicated by the area encircled within phantom lines in FIG. 9.

The cementing tool 10A is modified as compared to the cementing tool 10 in that the threaded connection 55 between anchor ring 54 and housing 12 has been replaced with a wedge lock ring apparatus generally designated by the numeral 300. An enlarged view of the general area surrounding wedge lock ring apparatus 300 is seen in FIG. 10. As will be understood upon reading the following description, the wedge lock ring apparatus 300 can generally be described as including portions of the housing 12A and anchor ring 54A which have surfaces defined thereon which are integral operating portions of the wedge lock ring apparatus 300. The anchor ring 54A may be more generally described as an inner sleeve 54A.

The housing 12A has a housing bore 34 which is defined by a housing inner radius 302. A housing groove 304 is defined within the housing bore 34 and has an upper housing groove tapered side 306 and a lower housing groove tapered side 308. The inner sleeve or anchor ring 54A has a cylindrical outer surface 310 having a sleeve groove 312 defined therein. The sleeve groove 312 has an upper sleeve groove tapered side 314 and a lower sleeve groove tapered side 316.

A lock ring 318, which may also be referred to as a wedge lock ring 318, is received in the housing groove 304 and sleeve groove 312. Lock ring 318 has an upper inner tapered edge 320 complementary to and engaging the upper sleeve groove tapered side 314. The lock ring 318 further includes a lower outer tapered edge 322 complementary to and engaging the lower housing groove tapered side 308. When a downward force is exerted upon anchor ring 54A relative to housing 12A, the wedged engagement between surfaces 320 and 314 and between surfaces 308 and 322 causes the anchor ring 54A and housing 12A to both be wedged against lock ring 318 so that no relative rotation between anchor ring 54A and housing 12A is permitted.

The lock ring 318 also has a lower ring inner tapered edge 324 and an upper ring outer tapered edge 326, respectively, defined thereon.

The lower sleeve groove tapered side 316 is complementary to the lower ring inner tapered edge 324, and the upper housing groove tapered side 306 is complementary to the upper ring outer tapered edge 326, so that in the event axial forces are reversed and there is an upward force acting on anchor ring 54A, the wedge lock ring 318 will still provide a wedge lock engagement of both the anchor ring 54A and housing 12A with the ring 318 to prevent relative rotation between anchor ring 54A and housing 12A. Such a situation could for example occur if the passage 18 through the cementing tool 10 were blocked and the pressures within the well bore below the cementing tool exceeded those above the cementing tool.

Where the terms "inner" and "outer" are used to describe the surfaces of ring 318, they are relative terms and refer to radial positions so that "outer" surfaces are on the radially outer side of ring 318 and "inner" surfaces are on the radially inner side of ring 318.

Figure 11:
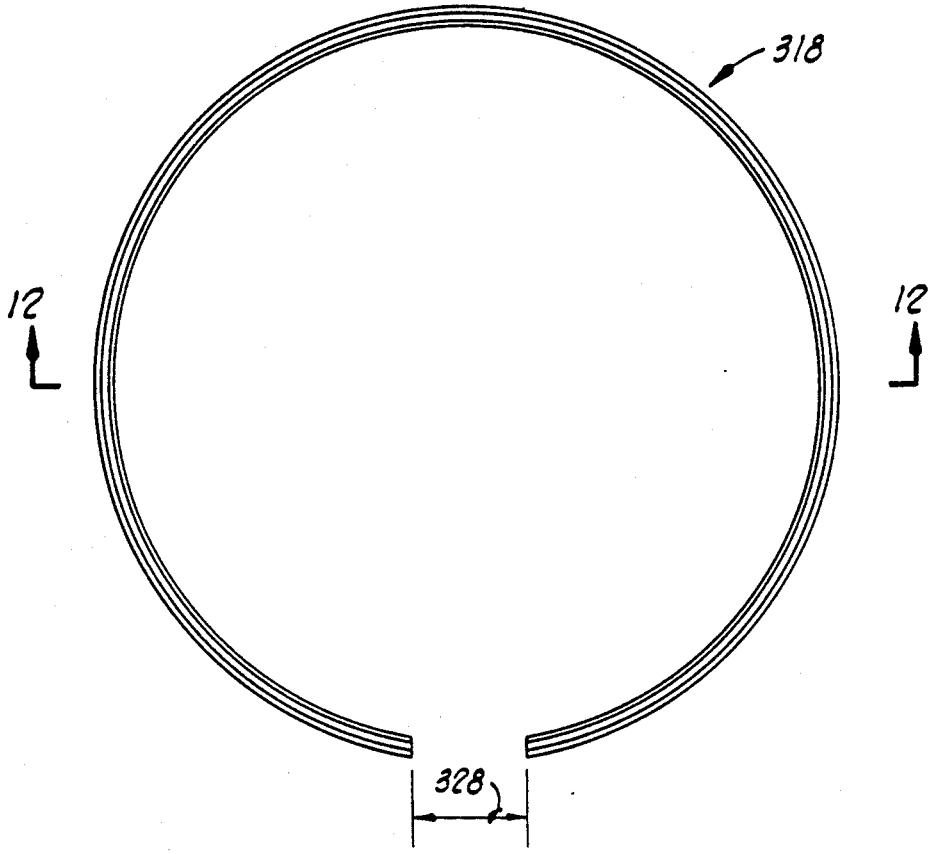
FIG. 11 is a plan view of the wedge lock ring.

As best seen in FIG. 11, the ring 318 is a split ring having a gap 328 defined therein. The ring 318 has a relaxed ring outer radius 330 which is greater than the housing inner radius 302. Thus, the ring 318 must be radially compressed to fit within the bore 34 of housing 12A.

The sleeve groove 312, as best seen in FIG. 10, has a sleeve groove depth 332 which is at least equal to, and preferably greater than, a radial thickness 334 of ring 318 so that ring 318 can be completely received within the sleeve groove 312.

The housing groove lower tapered side 308 can be described as facing generally axially upward and the sleeve groove upper tapered side 314 can be described as facing generally axially downwardly. The ring upper inner tapered edge 320 and ring lower outer tapered edge 322 can be described as facing generally axially upwardly and downwardly, respectively. Thus, the ring upper inner tapered edge 320 can be said to be generally opposed to the ring lower outer tapered edge 322.

Figure 13:
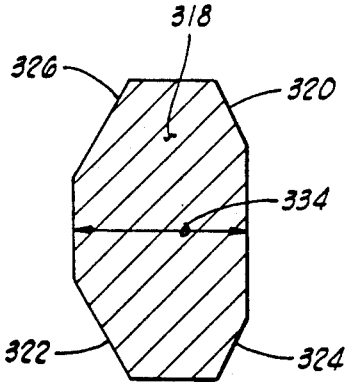
FIG. 13 is an enlarged view of a cross section of the wedge lock ring as seen in FIG. 10.

Furthermore, the ring upper inner tapered edge 320 and the ring lower outer tapered edge 322 may be said to be generally diagonally opposed across the cross section of lock ring 318 as best seen in FIG. 13.

Figure 12:
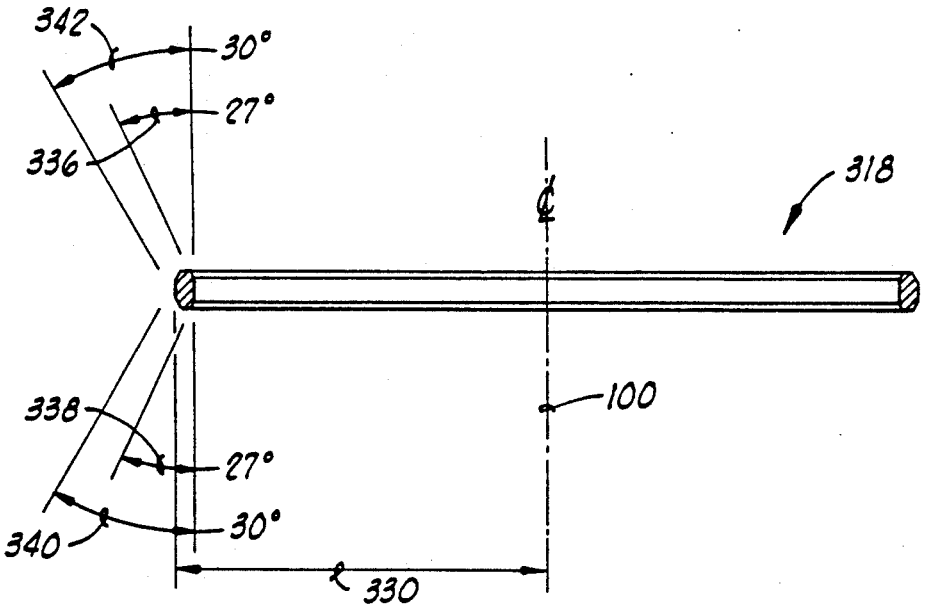
FIG. 12 is a sectioned elevation view of the wedge lock ring of FIG. 11 taken along line 12—12 of FIG. 11.

As best illustrated in FIG. 12, the ring inner tapered edges 320 and 324 define ring inner wedge angles 336 and 338, respectively, of 27° to the central axis 100 of the apparatus 10A. Similarly, the ring outer tapered edges 326 and 322 define ring outer wedge angles 340 and 342, respectively, each of 30°. Preferably, as shown in the illustrated embodiment, the ring outer wedge angles 340 and 342 are greater than the ring inner wedge angles 336 and 338. The outer wedge angles 340 and 342 are preferably sufficiently greater than the inner wedge angles 336 and 338 such that when the inner sleeve 54A is axially biased relative to the housing 12A, a resulting radial force on the lock ring 318 is radially outward so that the lock ring 318 is thus held in the housing groove 304.

It will be appreciated that when a downward force is applied to anchor ring 54A as seen in FIG. ? 0, the radially outward component of that force created by engagement of the 27° wedge angle between surfaces 320 and 314 will be somewhat greater than the radially inward component of force created by the wedging action between 30° surfaces 322 and 308, thus resulting in a resultant force which is radially outward thus physically holding the wedge lock ring 318 in place in the housing groove 304.

Since the angle of the complementary sleeve groove tapered sides 314 and 316 are equal to the angle 336 and 338, i.e., 27° in the example shown, those angles plus the necessary sleeve groove depth 332 define an axial length 350 of sleeve groove 322.

It is preferred that the angles 336 and 338 not be overly small because that would unnecessarily increase the length 350 of sleeve groove 312 and thus could increase the necessary length of anchor ring 54A and of outer housing 12A. Also, as the angles 336 and 338 are reduced, the radial outward component of force resulting from axial loads on anchor ring 54A increase, and thus too small an angle 336 or 338 could cause excessive radial loading on the outer housing 12A thus perhaps causing it to be deformed or swelled as a result of axial loading of sleeve 54A.

The housing groove 304 has a housing groove depth 344 best seen in FIG. 10 which defines a housing groove inner radius 346 from center line 100 to the outermost radial extent of groove 304.

As previously noted, the housing 12A has a bore 34 defined by a housing inner radius 302. The anchor ring 54A has an outer radius 348 (see FIG. 10) which may be generally referred to as a sleeve outer radius 348 which is slightly less than the housing inner radius 302 so that the sleeve 54A is closely slidably received within bore 34.

The ring radial thickness 334 of wedge lock ring 318 is greater than the housing groove depth 344 and is no greater than and preferably less than the sleeve groove depth 332.

The gap 328 of ring 318 allows the ring 318 to be radially compressed from its relaxed position of FIG. 11. The gap 328 is of sufficient size that the ring 318 can be compressed to have a compressed ring outer radius less than the housing inner radius 302 such that the ring 318 may be compressed within the annular sleeve groove 312 to allow the inner sleeve, i.e., the anchor ring, 54A to be slidably received within the bore 34 of housing 12A with the ring 318 compressed and held Within the sleeve groove 312.

The relaxed ring outer radius 320 of ring 318 as seen in FIG. 12 is greater than the housing inner radius 302 so that the ring 318 exerts a resilient outward radial force on the bore 34 of tubular housing 12A as the anchor ring 54A is inserted into the housing 12A such that when the ring 318 in annular sleeve groove 312 is positioned adjacent the annular housing groove 304, the ring 318 springs radially outward into the annular housing groove 304.

The various surfaces 320, 322, 324 and 326 defined on ring 318 can be defined generally as providing a cross-sectional ring profile means as seen in FIG. 13 for wedging the lock ring 318 with the annular sleeve groove 312 and the annular housing groove 304 when an axial force is exerted upon anchor ring 54A so that the lock ring 318 and the anchor ring 54A will not rotate relative to the tubular housing 12A. Thus, when a drill bit is engaged with the upper end of anchor ring 54A and is rotated to drill the anchor ring 54A out of housing 12A, the wedge lock ring 318 holds the anchor ring 54A fixed in place against rotation relative to the housing 12A while the anchor ring 54A is being drilled out.

The use of the wedge lock ring apparatus 300 shown in FIG. 9 provides a relative thinner overall radial thickness of the combined outer housing 12A and inner housing 54A than can generally be accomplished utilizing a threaded connection between those components.

The machining of the sleeve groove 312 and housing groove 304 is substantially easier and cheaper than machining of a threaded connection, and also the wedge lock ring apparatus is easier and cheaper to assemble than is a comparable apparatus with a threaded engagement.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of the invention may be made by those skilled in the art, which changes are encompassed within the scope and spirit of the present invention as defined by the appended claims.

What is claimed is:

1. A wedge lock ring apparatus, comprising:

a housing having a housing bore defining a housing inner radius, and a housing groove defined in said housing bore, said housing groove having first and second housing groove tapered sides;

an inner sleeve having a cylindrical outer surface with a sleeve groove defined therein, said sleeve groove having first and second sleeve groove tapered sides; and a split wedge lock ring received in said housing groove and said sleeve groove, said split wedge lock ring including:

first and second ring inner tapered edges complementary to said first and second sleeve groove tapered sides, respectively;

first and second ring outer tapered edges complementary to said first and second housing groove tapered sides, respectively;

a ring cross-sectional profile wherein said first ring inner tapered edge faces generally axially in a first direction and said first ring outer tapered edge is oriented generally axially in a second direction opposite said first direction, and said second ring inner tapered edge faces generally axially in said second direction and said second ring outer tapered edge is oriented generally axially in said first direction; and said first ring inner tapered edge engaging said first sleeve groove tapered side, and said first ring outer tapered edge engaging said first housing groove tapered side, such that said sleeve and housing are locked against relative rotation by wedged engagement with said split wedge lock ring.

2. The wedge lock ring apparatus of claim 1, wherein said lock ring has a relaxed ring outer radius greater than said housing inner radius.

3. The wedge lock ring apparatus of claim 2, wherein said sleeve groove has a sleeve groove depth sufficient to completely receive said split wedge lock ring.

4. The wedge lock ring apparatus of claim 1, wherein said first ring inner tapered edge and said first ring outer tapered edge are generally diagonally opposed.

5. The wedge lock ring apparatus of claim 2, wherein:

said first ring inner tapered edge defines a ring inner wedge angle relative to a central axis of said wedge lock ring; and said first ring outer tapered edge defines a ring outer wedge angle relative to said central axis of said wedge lock ring such that said ring outer wedge angle is greater than said ring inner wedge angle.

6. The wedge lock ring apparatus of claim 5, wherein said ring outer wedge angle is sufficiently greater than said ring inner wedge angle such that when said inner sleeve is axially biased relative to said housing a resulting radial force on said wedge lock ring is radially outward so that said wedge lock ring is held in said housing groove.

7. The wedge lock ring apparatus of claim 1, wherein said first ring inner tapered edge and said first ring outer tapered edge are generally diagonally opposed, and said second ring inner tapered edge and said second ring outer tapered edge are generally diagonally opposed.

8. The wedge lock ring apparatus of claim 1, wherein:

said first and second ring inner tapered edges define substantially identical ring inner wedge angles relative to a central axis of said wedge lock ring;

said first and second ring outer tapered edges define substantially identical ring outer wedge angles relative to said central axis of said wedge lock ring; and said outer wedge angles being greater than said inner wedge angles such that when said inner sleeve is axially biased in either axial direction relative to said housing a resulting radial force on said wedge lock ring is radially outward so that said wedge lock ring is held in said housing groove.

9. The apparatus of claim 1, wherein said apparatus is a cementing tool, and said inner sleeve is a drillable inner sleeve.

10. A method of drilling out a portion of a well tool, said method comprising:

holding an inner tool component against rotation relative to an outer housing by wedging said inner tool component and said outer housing against a wedge lock ring held therebetween, said holding step including:

wedging an inner tool component groove taper located within an inner tool compartment groove defined on said inner tool component with a complementary inner ring tapered defined on said wedge lock ring; and wedging a housing groove taper located within a housing groove defined within said housing with a complementary outer ring taper defined on said wedge lock ring; and drilling out said inner tool component while it is held against rotation by said wedge lock ring.

11. The method of claim 10 wherein:

said holding step includes a step of applying a generally downward longitudinal force on said inner tool component with a drill bit which is performing said drilling step.

12. The method of claim 11 wherein:

said holding step includes the step of translating said generally downward longitudinal force into a radially outward ring biasing force by providing a ring inner wedge angle and a ring outer wedge angle relative to a longitudinal axis of said tool such that said ring outer wedge angle is greater than said ring inner wedge angle.

* * * * *